United States Patent [19]

McManus

[11] 4,259,822

[45] Apr. 7, 1981

[54] PRECAST CONCRETE JOIST SYSTEM

[76] Inventor: Ira J. McManus, 39 Lincoln Ave., Florham Park, N.J. 07940

[21] Appl. No.: 39,227

[22] Filed: May 14, 1979

[51] Int. Cl.[3] ..... E04B 1/16

[52] U.S. Cl. ..... 52/334; 52/336

[58] Field of Search ..... 52/334, 336

[56] References Cited

U.S. PATENT DOCUMENTS

| | | | |
|---|---|---|---|
| 1,828,078 | 10/1931 | Sealey | 52/327 |
| 1,863,258 | 6/1932 | Tashjian | 52/336 |
| 3,624,980 | 12/1971 | McManus | 52/327 |
| 3,683,580 | 8/1972 | McManus | 52/334 |
| 4,056,908 | 11/1977 | McManus | 52/334 |

*Primary Examiner*—Alfred C. Perham

[57] ABSTRACT

An improved concrete slab and steel construction wherein a pan is extended between adjacent joists, said pan having a bend line axially along its length, a portion of said pan resting a joist, a second portion being transversely notched such that said pan straddles adjacent joists at said notches, said pan serving to support poured in place concrete such that said concrete haunches down to supporting beams, thereby forming a composite concrete slab and steel structure.

16 Claims, 7 Drawing Figures

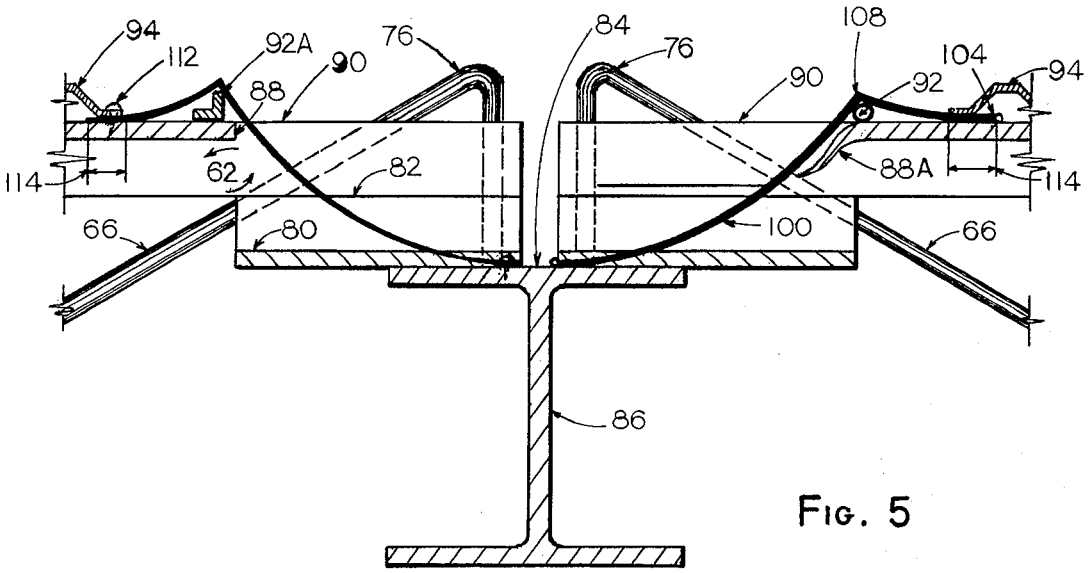
FIG. 5
FIG. 6
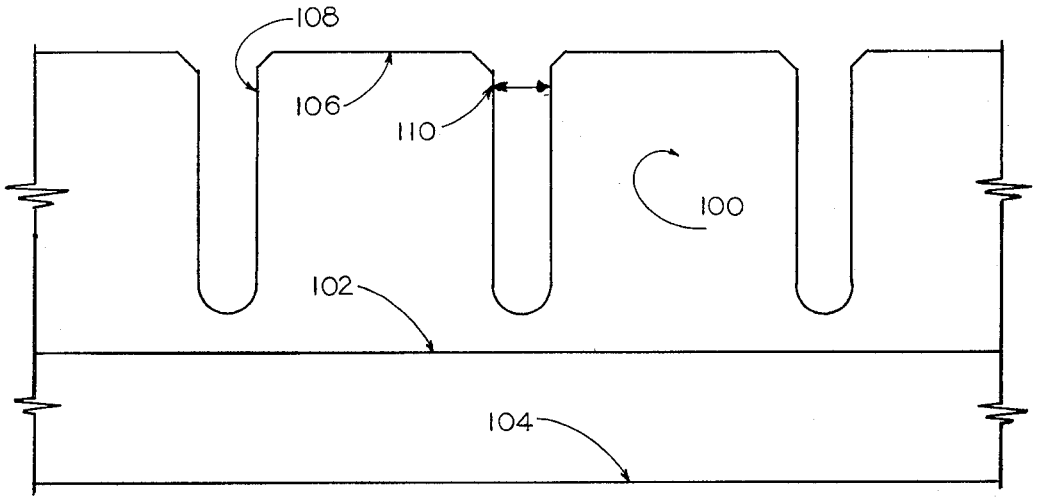

PRECAST CONCRETE JOIST SYSTEM

BACKGROUND OF THE INVENTION

1. Field of the Invention

The present invention relates to concrete slab and steel construction and is directed particularly to improved apparatus and techniques for providing such construction.

2. Description of the Prior Art

The improved apparatus and techniques of the present invention pertain specifically to an improvement in providing concrete slab and steel joist construction disclosed in the present inventor's copending U. S. Patent Applications, Ser. Nos. 865,632, filed 12/29/77 and now abandoned, 491,696; and 930,950 filed 8/4/78 and now U.S. Pat. No. 4,189,883 and to U. S. Pat. Nos. 3,392,499; 3,457,818; 3,527,007; 3,624,980; 3,683,580; 3,728,835; and 4,056,908.

In the prior art techniques now commonly used for providing concrete slab and steel construction, there often occurs leakage of the concrete from the openings and joints of the pans employed to retain the poured concrete, this leading to possible faulty or less desirable concrete slabs, waste of concrete, the necessity for expending labor, money, and time to clean the spilled concrete, and other disadvantages. The present invention overcomes, or at least substantially alleviates this problem of leakage and the attendant disadvantages.

In a prior art technique used for providing poured concrete slabs, composite joists 20 (FIG. 1) are provided with their end portions 22 disposed on and welded to a composite beam 24, it being desirable that the concrete 25 poured to provide the slabs, haunch down onto the supporting beam 24, as shown in FIG. 1. The composite joists 20 comprise top chord angle members 26, lower chord angle members 30, and steel joist webbing 34, the top and bottom chord angle members 26, 30 are generally L-shaped, the top chord angle members 26 being inverted and having their vertical legs joined in back-to-back relation, as shown, with the steel joist webbing 34 extending therebetween. The lower chord angle members 30 have their vertical legs in back-to-back relation, with the steel joist webbing 34 located therebetween, the steel joist webbing 34 extending between the upper chord angle members 26 and the lower ones 30.

The end portions 32 of the top chord angle members 26 intersect the beam 24 and are generally c-shaped in cross-section so that each such member 26 has two horizontal legs. The lower horizontal legs 35 of the upper chord members 26 rest on and are welded to the beam 24 to provide a joist seat. Support rods 36 are welded to and extend transversely across the tops of the top chord angle members 26 of the composite joists 20.

Between each pair of laterally adjacent joists 20, at the region of their juncture with beam 24, there are disposed a pair of flange-edged pans 40 that have their flanged ends 42 resting on the pan support rods 36 and have their other opposite ends resting on the interior surfaces of the lower horizontal legs 35 of the upper chord members 26 and on the beam 24, so that pans 40 slope downwardly and inwardly toward the beam 24. The side edges of the pans 40 are inserted between the upper and lower horizontal legs 44 and 35, respectively of the upper chord members 26, but the pans 40 do not extend laterally over the joists 20.

Beyond the area of intersection of the composite joists 20 and the pan 40 there are corrugated metal sheets 50 that are located over the composite joists 20, the corrugated sheets 50 overlapping the flanged ends 42 of pans 40. The steel joist webbing 34 comprises upper apex portions 52 that protrude through and above the upper chord members 26 of the joist 20 and through the corrugated sheet metal framework 50 so as to anchor the poured concrete, there being pins 54 inserted between the pan 40 and the webbing apices 52.

Because the pans 40 are individually handled, there are a number of drawbacks that are described below. Also, because the pans 40 do not extend laterally beyond the upper chord members 26 and because the corrugated metal sheets 50 generally can be positioned only so that they extend only up to or slightly short of the pan support rods 36 and the bend 56 at the flange ends 42 of the pans 40, poured concrete can leak through the space between the upper chord members 26 and the pans 40, leading to the above described disadvantages.

Because the prior art fitted the individual sheet metal pans 40 between the ends of the joists 20 to allow the concrete to haunch down onto the supporting beam 24, it was necessary to expend considerable time and money in the field, this because each such pan 40 covered only the space between two adjacent joists and had to be individually handled and fitted into place and secured to the support rods 36.

OBJECTS OF THE INVENTION

An object of this invention is to provide an improved apparatus for providing concrete and steel construction.

Another object is to provide for improved poured-in-place concrete slab and steel joist construction.

Still another object is to provide improved composite pan apparatus for providing poured-in-place concrete slabs.

A further object is to provide improved formwork at the ends of the open web joists, that permits composite action between the supporting beam and the concrete.

Other objects, features, and advantages of the invention will be apparent from the following description, when read with reference to the accompanying drawings.

DESCRIPTION OF THE DRAWINGS

FIG. 5 is a side elevation view depicting the pan of the present invention disposed in place, according to another embodiment of the invention.

FIG. 6 is a top elevation view depicting the pan of the present invention in place according to yet another embodiment of the invention.

PREFERRED EMBODIMENTS

Figure 1:
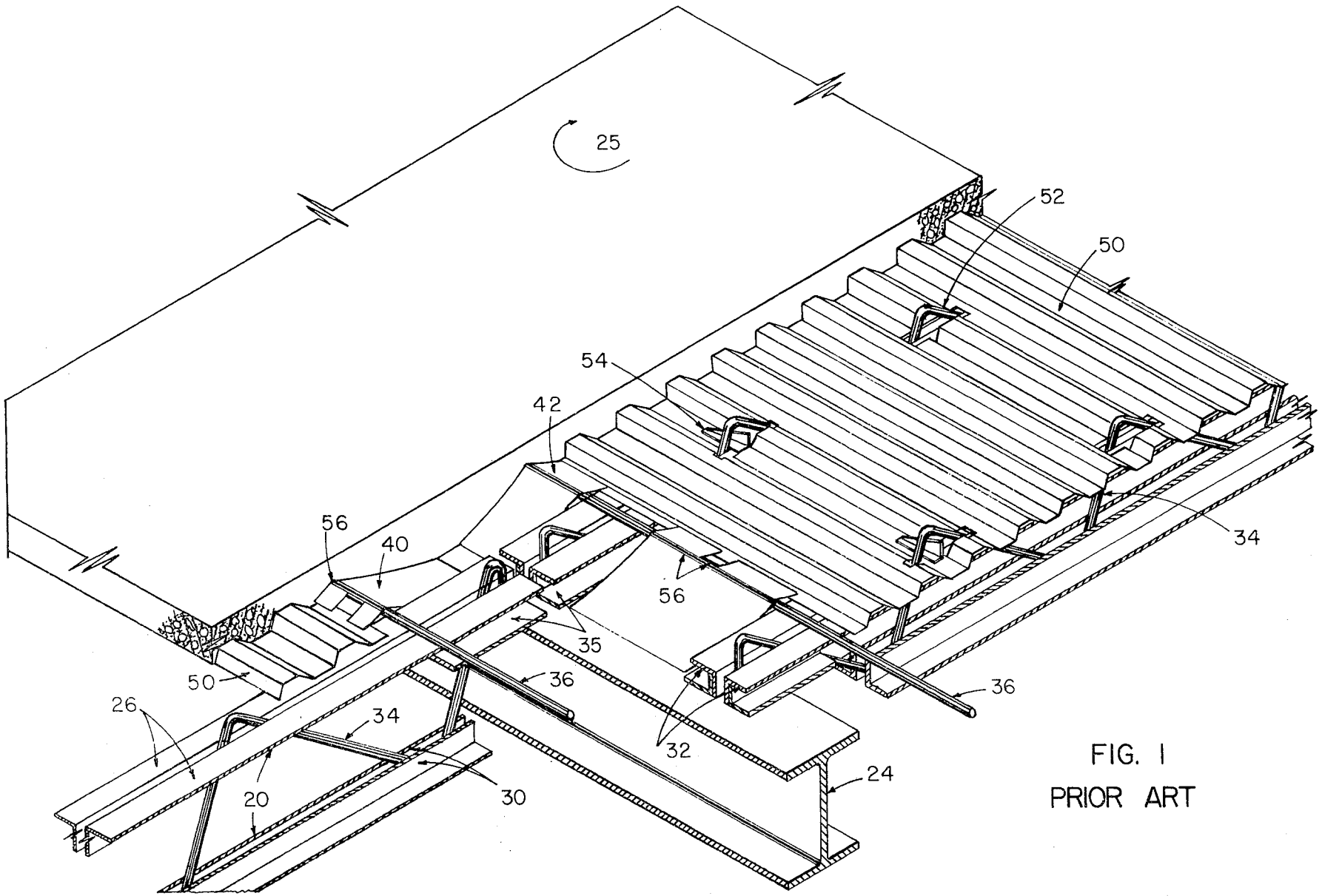
FIG. 1 PRIOR ART
FIG. 1 is a perspective view depicting the prior art mode and apparatus for producing poured-in-place concrete slabs.
Figure 1A:
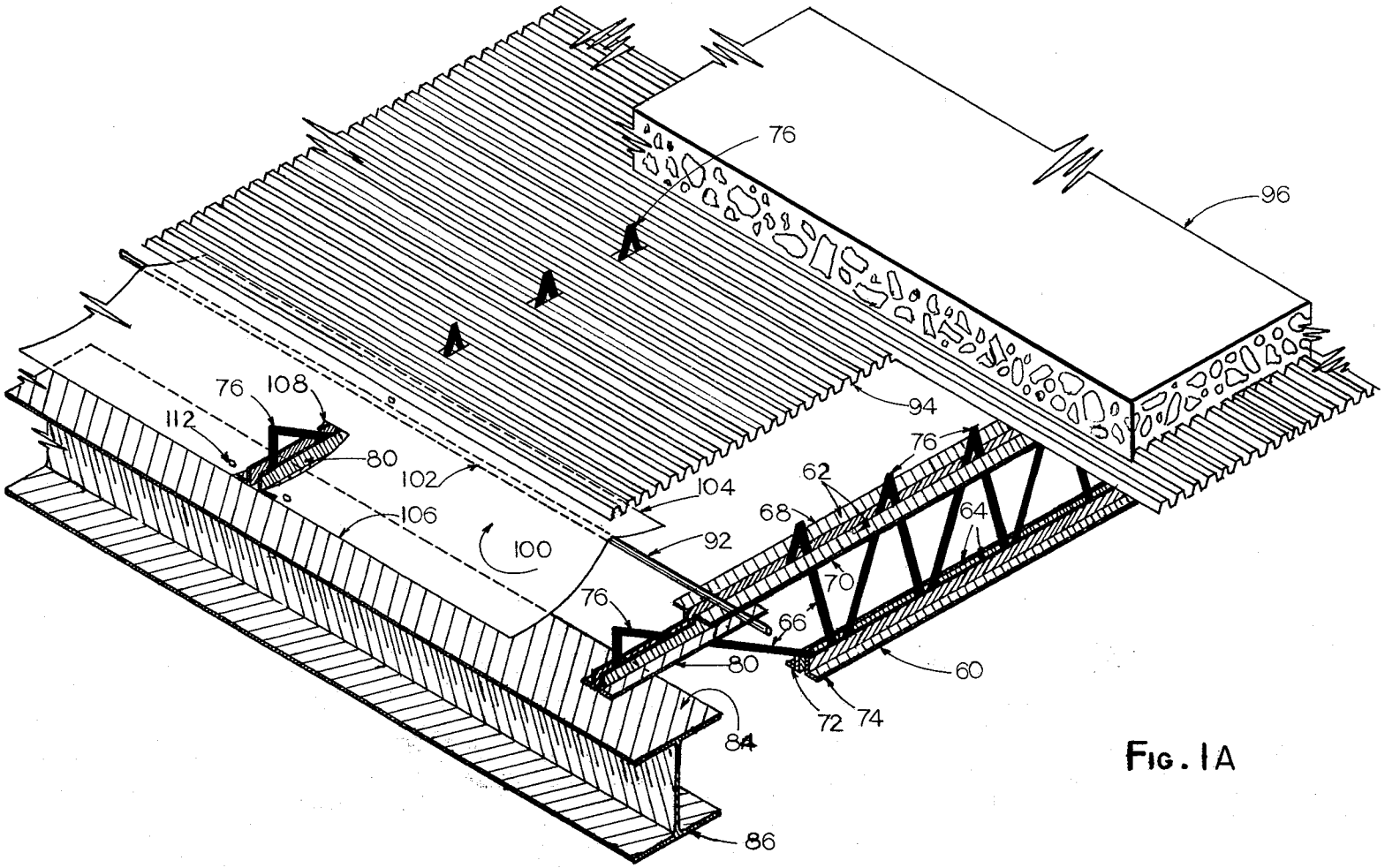
FIG. 1A is a perspective view of new mode and apparatus of the present invention for producing poured in place concrete slabs in place during use.

Referring to FIG. 1A, the composite joists 60 comprise upper chord members 62, lower chord members 64, and steel joist webbing 66, the steel joist webbing 66 extending between the upper and lower chord members 62, 64. The upper chord members 62 each comprise a pair of upper chord angle members 68, 70 (FIG. 5) that are later described herein. The lower chord members 64 each comprise a pair of lower chord angle members 72, 74 and the steel joist webbing 66 is partially located between the paired upper chord angle members 68, 70 and partially located between the lower chord angle members 72, 74, with upper apex portions 76 that protrude through and above the upper chord members 62, as hereinbefore described with reference to FIG. 1.

The upper chord angle members 68, 70 each comprise a lower horizontal leg portion 80 that is connected to the lower end of the vertical central portion 82 of the upper chord angle members 68, 70, which lower leg portions 80 rest on the upper horizontal flange 84 of the beam 86 and provide joist seat angles, the upper chord angle members 68, 70 also each comprise an upper horizontal leg portion 88 that extends along only a part of the length of the upper chord angle members 68, 70, there being no upper horizontal leg portion 88 at least one end portion 90 of the upper chord angle members 68, 70, for reasons described below. Where the two ends of the upper chord angle members are to be positioned on respective beams 88, then both ends should have no upper horizontal leg portion 88, for reasons that will be apparent hereinafter.

Pan supporting means, such as rods 92 extend transversely to the upper chord members 62, it being preferred that the rods 92 be connected to the upper chord members 62, such as by welds. It is also preferred that the pan support rods 92 be disposed at the ends of the upper horizontal leg portions 88. Corrugated metal sheets 94 are disposed on the upper chord members 68, 70 in the fashion familiar to the art.

The pan 100 (FIG. 2) of the present invention comprises an elongated band whose length is several times the width between adjacent joists 60, so that a single pan spans plural, i.e. three or more, such joists 60. The pan 100 comprises a bend line 102 (FIG. 2) that extends longitudinally along the length of the pan, the bend line 102 being between a first portion 104 of the pan 100 that is adapted to rest at least partially on the upper cord angle members 68, 70 of the joists 60, and a second portion 106 that comprises plural notches or cutouts 108 that extend transversely to the longitudinal direction or axis of the pan 100. The width of the notches preferably are substantially equal to the thickness of the vertical central portions 82 of the upper chord members 68, 70 of the various joists i.e., the distance between the outward facing surfaces of the adjacent vertical portions 82 of the upper chord members 68, 70, such that the end portions 90 of the various joists seat are straddled by the pan 100, as shown in FIG. 5. Where it is desired, the notches 108 can be outwardly flared, as shown in FIGS. 3 and 6 to fit the joist seat angles if required.

Figure 4:
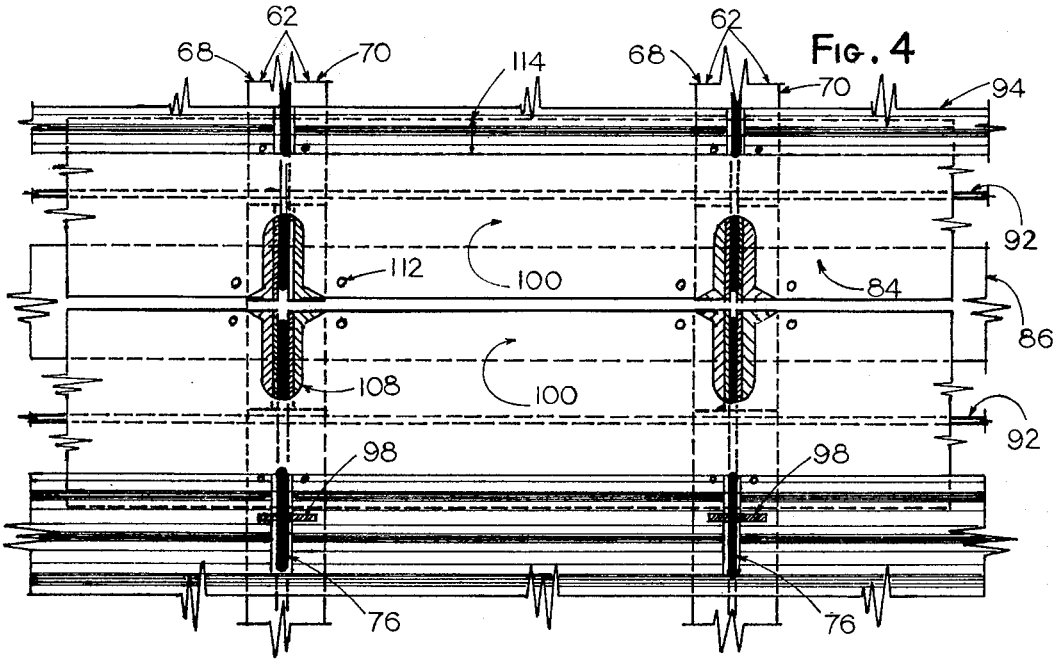
FIG. 4 is a top view of the pan of the present invention in place during use.

When the pan is located in place for pouring concrete, the pan support rods 92 are located at a substantial distance from both edges 110, 114 preferably at the vicinity of the pan bend line 102, with the joist end portions 90 inserted in the pan notches 108 and the first portion 104 of the pan 100 disposed over the upper horizontal leg portions 88 of the upper chord angle members 68, 70. The edges 106 of the second portion 106 of the pan 100 are disposed on the beam 86 and on the lower horizontal legs 80 of the upper chord angle members 68, 70, it being preferred that the pan first portion 104 be connected to the upper chord angle members 68, 70 for example, welds, screw, or other connecting means, there being screws 112 shown in FIG. 4. It can be seen that in the prior art the pans 40 extend only between adjacent joist 60, but do not extend over or straddle joists. (FIG. 5)

The corrugated metal sheets or decking 94 is disposed over at least the edge parts 114 of the pan first portion 104, to provide, in conjunction with the novel pan apparatus 100 of this invention, a substantially continuous form for receiving the poured concrete, thereby minimizing concrete leakage and providing other benefits, as well.

It can be seen that the present invention embodies a continuous pan which, when placed in position, will close off multiple spaces between joist ends instead of each prior art pan closing only the single space between adjacent joists in a single operation. Also, the continuous pan 100 is not fitted, since it is merely placed over the joist ends that have been modified by removing (or crimping, shown in FIG. 5) the horizontal leg portion at the top of the joist at the bearing end 90, as described herein.

Aside from the foregoing, the continuous pan 100 of the present invention affords a significant increase in the strength of the pan, which reduces the possibility of the pan's being pulled off the angle or support rod 92 under the weight of the wet concrete or due to a worker stepping on it, which possibility is significant with prior art individual pans, even when such prior art pans are hooked over or attached to the support rods 92. It can be seen from FIG. 1, that the prior art pans 40 are supported by rods 36 at an edge portion thereof while the pan of the present invention is supported by the rod at a central part thereof. Also, the pan of the present invention is partly supported by and rests on the joist members at their top legs 88. Further, the present pans are secured) by screws, etc.) to the cross beam 86 and can be secured to the joist members 68, 70.

The pan 100 of the present invention preferably has its first and second portion 104, 106 angularly disposed with respect to each other. This provides additional strength to the pan 100, since there is increased rigidity developed at the region of the bend line.

Figure 2:
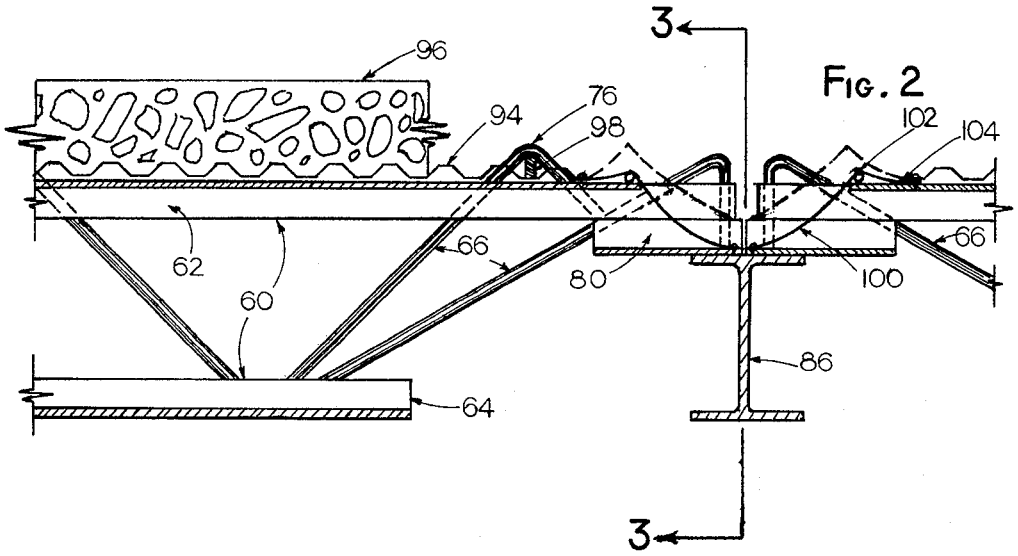
FIG. 2 is a schematic side elevational view of the formwork at the ends of open web joists, for receiving poured concrete, same embodying the present invention.
Figure 3:
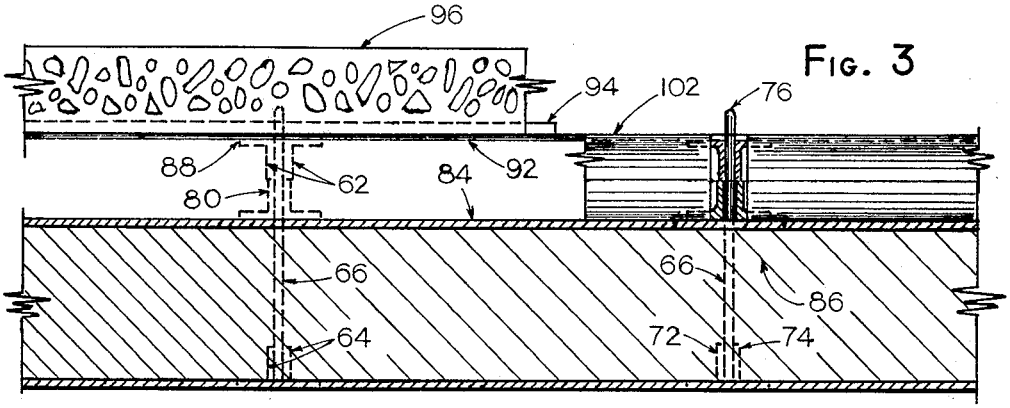
FIG. 3 is an end top view of a pan according to an embodiment of this invention.

Also, it is preferred that one or both of the first and second portions 104, 106 be curved, as shown in FIG. 2. This is for increased pan strength and rigidity. It is further preferred that the angle be such that, prior to attachment of the pan (by screws, welds, etc.) to the joists (as explained previously) the bend line 102 be spaced from and above the support angle or rod 92, so that when the pan 100 is pushed down onto the support angle or rod 92, a second curve is formed on each side of the bend line to give the pan 100 considerable stiffness and strength against bending under the weight of the wet concrete load.

While the prior art pans required that the pan support rod or angle be located directly against the end of the corrugated decking to prevent concrete leakage and thus required the distance between the support rod or angle and the region at the bearing end of the joist to vary according to the spacing of the supporting conposite beams, this drawback is avoided by the present invention, where the first portion 104 of the pan, which rests on the upper chord 68, 70 of the joist 60, permits the corrugated decking to lap over it at random. Thus, while the prior art pan required, because of the varying pan width requirements, that a number of different pans having varying widths, be on hand at a job, this is not so with the present invenion since the region at the bearing end of the joist can be held to a substantially constant dimension.

The present invention provides the further benefits of increased economy and speed of installation, since it does not have to be cut to size on the job, one pan size being usable for a great many varieties of jobs and, further, because its increased strength permits thinner (and, therefore, lighter) sheet to be used for the pans.

Referring to FIG. 5, the ends of the upper horizontal leg portions 88 of the upper chord angle members 68, 70, of the upper chords can be cut off (FIG. 6) crimped down (as at 88A in FIG. 5) to remove, or reduce the extent of, the horizontal leg portions 88 of the upper chord angle member 68, 70, which receive the pan 100, whose first portion 104 can be secured to the remaining part of the horizontal leg portion 88 remaining at a distance from the bearing end of the upper chord angle members 68, 70, such securing being achieved by, e.g., screws 112.

I claim:

1. An apparatus for providing concrete slab and steel contruction, comprising:

(a) plural composite joist members disposed in a predetermined structural arrangement, in spaced apart relationship, at least one of said joist members comprising a beam element having a vertical central portion and a horizontal leg portion connected to said vertical central portion, said beam element having an end portion free of said horizontal leg portion;

(b) supporting means disposed at said joist members;

(c) a pan member comprising an elongated band whose length is greater than the distance between adjacent joists such that said pan member spans plural ones of said joists in the vicinity of said beam end portion.

2. An apparatus as in claim 1, wherein said pan member comprises a bend line extending axially along the length of said pan, said pan comprising first and second portions disposed at opposite sides of said bend line.

3. An apparatus as in claim 2, wherein said first portion is adapted to rest at least partially on said joist members associated therewith.

4. An apparatus as in claim 2, wherein said pan member is disposed so that said supporting means is disposed generally at said bend line.

5. An apparatus as in claim 2, wherein said second portion comprises plural notches that extend generally transversely said bend line.

6. An apparatus as in claim 5, wherein said joist members each comprise vertical central portions and said notches have respective widths substantially equal to the thickness of a vertical central portion.

7. An apparatus as in claim 5, wherein said pan member is adapted to straddle said joist members associated therewith, with said joist members disposed at respective ones of said notches.

8. An apparatus as in claim 5, wherein said notches are outwardly flared.

9. An apparatus as in claim 5, wherein said pan member is adapted to be disposed at said joist members so that a least one of said first and second portions has a curved profile.

10. An apparatus as in claim 2, wherein said first portion is adjusted to be secured to said joist members associated therewith.

11. An apparatus as in claim 2, comprising decking elements that are disposed at and partly overlap said pan joist portions.

12. An apparatus as in claim 2, wherein said joist members are adapted to be supported in a beam member and second portion is adapted to be secured to said beam members associated therewith.

13. An apparatus as in claim 1, wherein said pan member covers portions of the respective joist members associated therewith.

14. An apparatus as in claim 1, wherein said pan member includes oppositely disposed edge portions, said pan member being adapted so that said supporting means is disposed at a substantial distance from said edge portions.

15. An apparatus as in claim 1, wherein said pan member comprises first and second portions and said pan member is adapted to be disposed so that said first and second portions are angerlarly disposed with respect to each other, said first portions extending over the joist members associated with said pan.

16. An apparatus for providing concrete slab and steel construction, comprising:

(a) plural composite joist members disposed in a predetermined structural arrangement, in spaced apart relationship, at least one of said joist members comprising a beam element having a vertical central portion and a horizontal leg portion connected to said vertical central portion, said beam element having an end portion, said horizontal leg portion being crimped at said end portion;

(b) supporting means disposed at said joist members;

(c) a pan member comprising an elongated band whose length is greater than the distance between adjacent joists such that said pan member spans plural ones of said joists in the vicinity of said beam end portion.

* * * * *